US007645928B2

(12) United States Patent
Graham et al.

(10) Patent No.: US 7,645,928 B2
(45) Date of Patent: Jan. 12, 2010

(54) BASS DRUM SYSTEM AND METHOD

(76) Inventors: James Leverne Graham, 8567 Vine Valley Dr., Sun Valley, CA (US) 91352; Michael Robert Lizarraga, 318 N. Reese Pl., Burbank, CA (US) 91506

( * ) Notice: Subject to any disclaimer, the term of this patent is extended or adjusted under 35 U.S.C. 154(b) by 0 days.

(21) Appl. No.: 11/862,159

(22) Filed: Sep. 26, 2007

(65) Prior Publication Data

US 2009/0078106 A1 Mar. 26, 2009

(51) Int. Cl.
*G10D 13/02* (2006.01)

(52) U.S. Cl. ..... 84/421; 84/327

(58) Field of Classification Search ..... 84/421, 84/327

See application file for complete search history.

(56) References Cited

U.S. PATENT DOCUMENTS

| | | | | | |
|---|---|---|---|---|---|
| 516,612 | A | * | 3/1894 | Rappold | 84/422.2 |
| 1,288,179 | A | * | 12/1918 | Poehland | 84/280 |
| 1,630,701 | A | * | 5/1927 | Gladstone | 84/421 |
| 2,505,882 | A | * | 5/1950 | Cassato | 84/421 |
| 3,096,677 | A | * | 7/1963 | Ryan | 84/421 |
| 3,543,632 | A | * | 12/1970 | La Flame | 84/453 |
| 3,598,011 | A | * | 8/1971 | Henkle | 84/280 |
| 3,710,670 | A | * | 1/1973 | Winkler | 84/421 |
| D252,463 | S | * | 7/1979 | Cocuzzo | D17/22 |
| 4,240,646 | A | * | 12/1980 | Scott | 280/30 |
| 4,254,901 | A | * | 3/1981 | McIntosh | 224/258 |
| 4,441,398 | A | * | 4/1984 | Baker | 84/421 |
| 4,829,874 | A | | 5/1989 | Hoshino | |
| 5,063,821 | A | * | 11/1991 | Battle | 84/723 |
| D352,951 | S | * | 11/1994 | Choate | D17/22 |
| 5,677,502 | A | | 10/1997 | Laido | |
| 5,744,738 | A | * | 4/1998 | Gatzen | 84/421 |
| 5,797,569 | A | * | 8/1998 | Simons | 248/187.1 |
| 5,977,464 | A | * | 11/1999 | Bencomo, Jr. | 84/421 |
| 5,994,634 | A | | 11/1999 | Cady | |
| 6,063,993 | A | * | 5/2000 | Hoshino | 84/422.1 |
| 6,215,054 | B1 | * | 4/2001 | Woodhouse et al. | 84/421 |
| 6,399,865 | B1 | * | 6/2002 | Ishimatsu | 84/421 |
| 7,074,997 | B2 | * | 7/2006 | Steele | 84/422.1 |
| 7,435,888 | B2 | * | 10/2008 | Steele | 84/422.1 |
| 2007/0256538 | A1 | * | 11/2007 | Parra | 84/422.1 |
| 2009/0078106 | A1 | * | 3/2009 | Graham et al. | 84/421 |

OTHER PUBLICATIONS

Musician John Ezell has drum tied to chair, photo from 1997, viewed at www.deltablues.net/gull.html, playing at the Gully Alley Inn in Moorhead, Mississippi.*

* cited by examiner

*Primary Examiner*—Jeffrey Donels
*Assistant Examiner*—Robert W Horn
(74) *Attorney, Agent, or Firm*—Wasserman, Comden & Casselman, L.L.P.; Reid Eric Dammann

(57) ABSTRACT

A bass drum system and method is provided. The bass drum system is comprised of a bass drum including at least one connector and an anchoring harness. The anchoring harness includes at least one first securing point, an anchoring body, and at least one second securing point. The at least one first securing point is connected to the anchoring body at a predefined distance from the at least one second securing point, also connected to the anchoring body. The at least one first securing point attaches to the at least one connector of the bass drum and the anchoring body contacts a seat structure used by a musician. The at least one second securing point attaches to the at least one connector.

11 Claims, 5 Drawing Sheets

BASS DRUM SYSTEM AND METHOD

BACKGROUND

1) Field of the Invention

The invention relates to a bass drum. More particularly, the invention relates to the prevention of movement exhibited by a bass drum during play.

2) Discussion of the Related Art

Bass drum players repeatedly strike the bass drum with a foot pedal during play. The force from the foot while using the foot pedal to beat the drum drives the bass drum away from the player, retarding the required force need to play the music. The reduction in force causes variations which compromises sound quality. Moreover, the movement serves as a distraction to the player and forces constant repositioning of the drum, leading to the interruption of the music played.

Generally, bass drum players depend on the weight of the bass drum to prevent it from moving. However, musicians have nailed pieces of wood to the stage in front of the bass drum, placed bricks and/or sandbags in front of the bass drum, used carpet, or placed pins on the bottom of the bass drum legs to prevent movement of the bass drum during play.

The prior art is burdensome to the musician because the material used leads to an increase in equipment weight, requiring more space to transport and store. Moreover, affixing the prior art to the music stage or to the bottom of the bass drum is complex. The procedures require time and effort, and also result in damaged venues. Most importantly, the prior art does not prevent the bass drum from movement during play.

BRIEF DESCRIPTION OF THE DRAWINGS

The invention is described by way of example with reference to the accompanying drawings where.

DETAILED DESCRIPTION OF THE INVENTION

Figure 1:
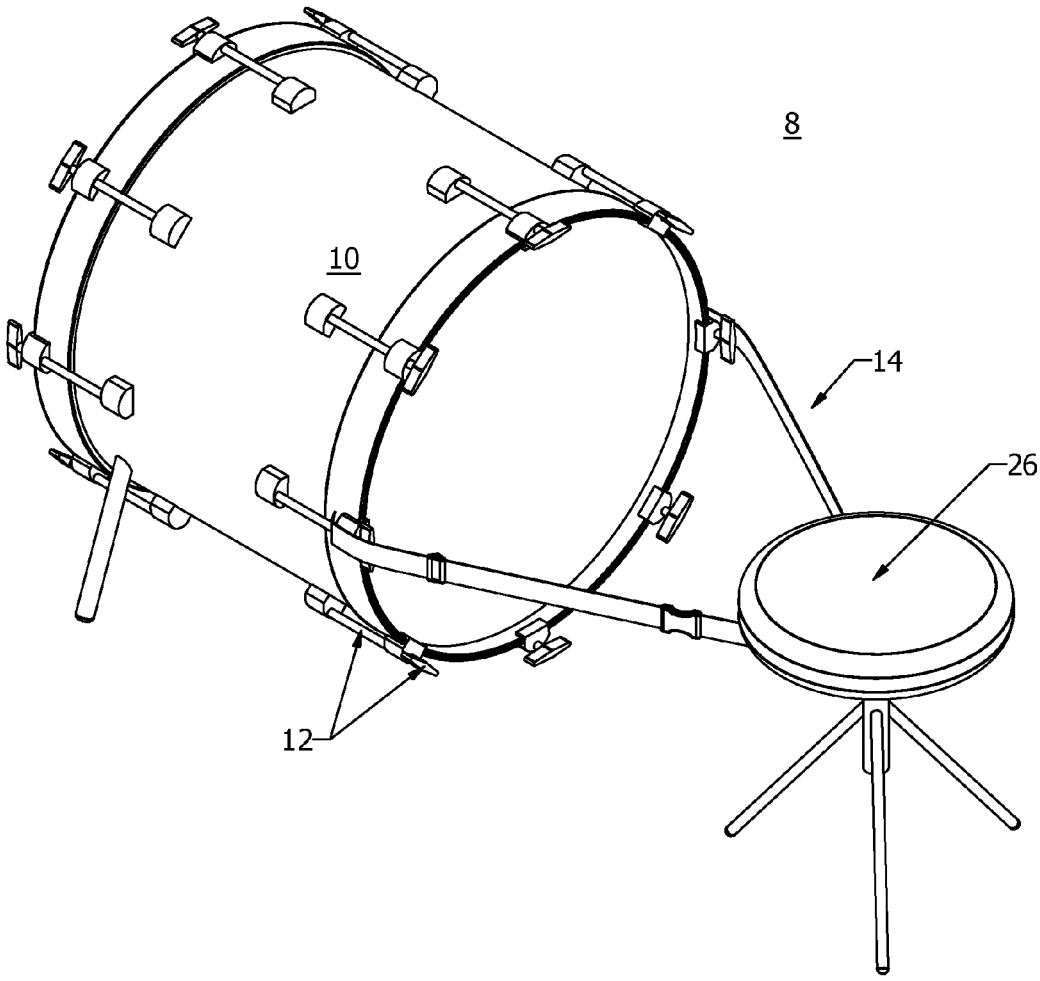
FIG. 1 illustrates a bass drum system.

FIG. 1 illustrates a bass drum system 8. The bass drum system 8 is comprised of a bass drum 10 and an anchoring harness 14. The bass drum 10 includes at least one connector 12, and is anchored by the attachment of the anchoring harness 14 to the at least one connector 12 and to a seat structure 26.

Figure 2:
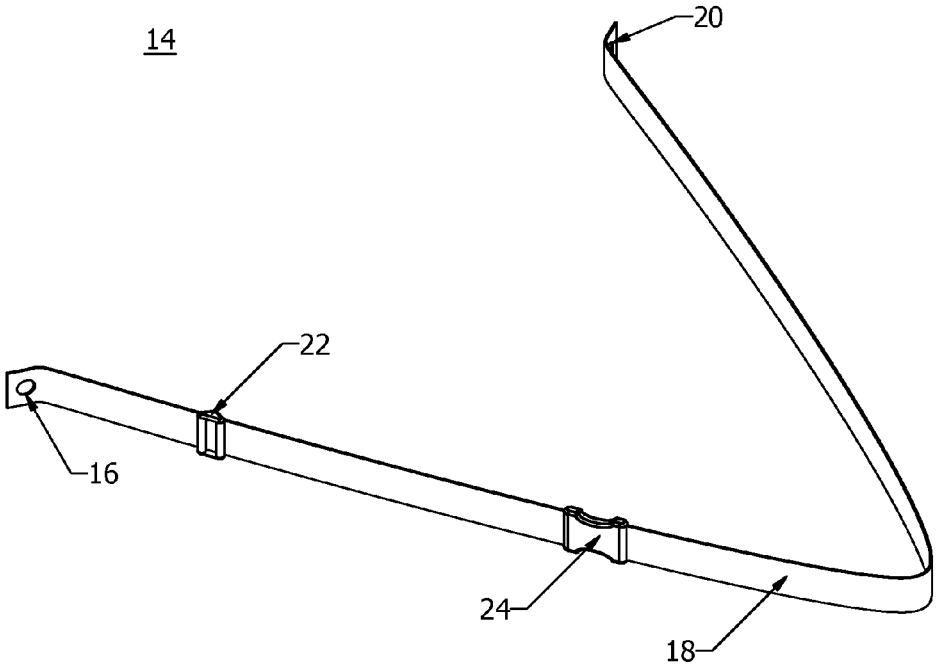
FIG. 2 illustrates an anchoring harness.
Figure 3:
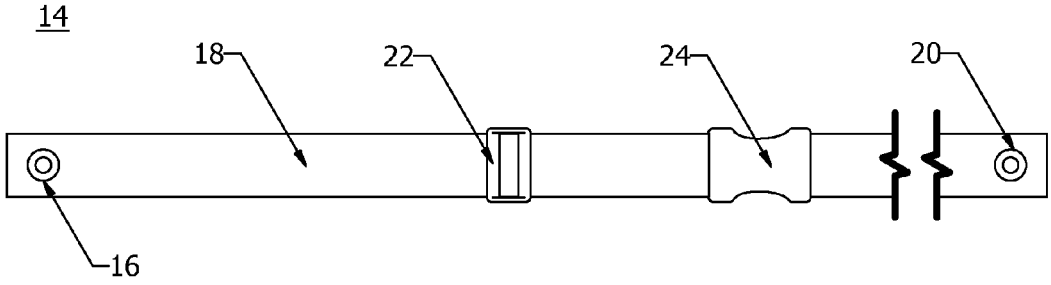
FIG. 3 illustrates a side view perspective of the anchoring harness.

FIGS. 2 and 3 illustrate the anchoring harness 14. The anchoring harness 14 is comprised of at least one first securing point 16, an anchoring body 18, and at least one second securing point 20. In an embodiment, the anchoring harness 14 includes at least one modifying member 22. In another embodiment, the anchoring harness 14 includes a fastening member 24.

Figure 4:
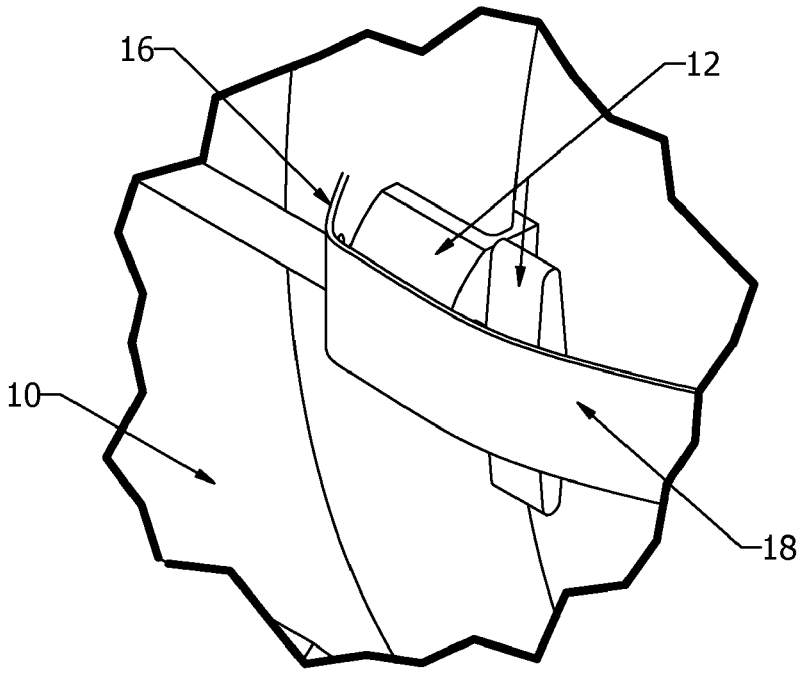
FIG. 4 illustrates at least one first securing point of the anchoring harness attached to at least one connector of the bass drum.
Figure 5:
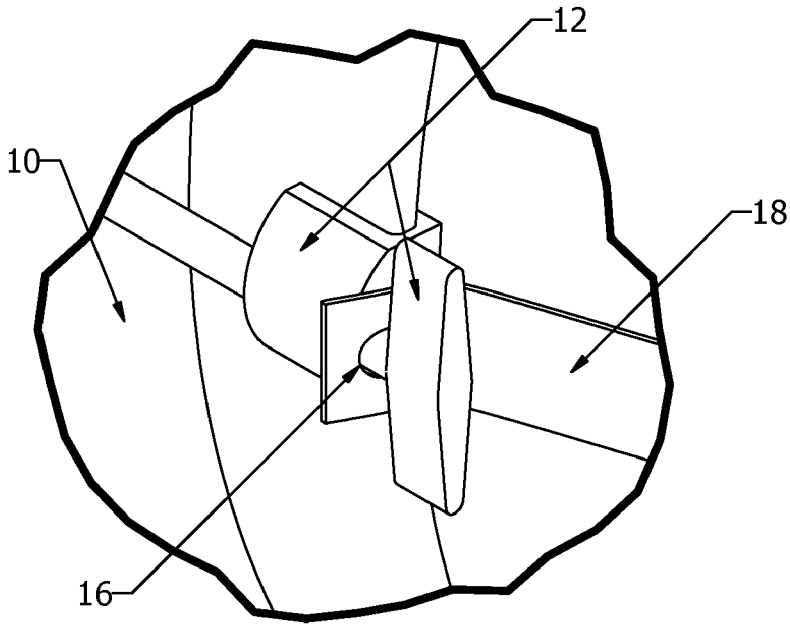
FIG. 5 illustrates the at least one first securing point of the anchoring harness attached to at least one connector of the bass drum.

FIGS. 4 and 5 illustrate the attachment of the at least one first securing point 16 to the bass drum 10, in detail. The at least one first securing point 16 is located at a predefined distance from the at least one second securing point 20, and is attached to the at least one connector 12 of the bass drum 10. FIG. 5 illustrates an embodiment, wherein the at least first securing point 16 attaches to a different location on the at least one connector 12.

Figure 6:
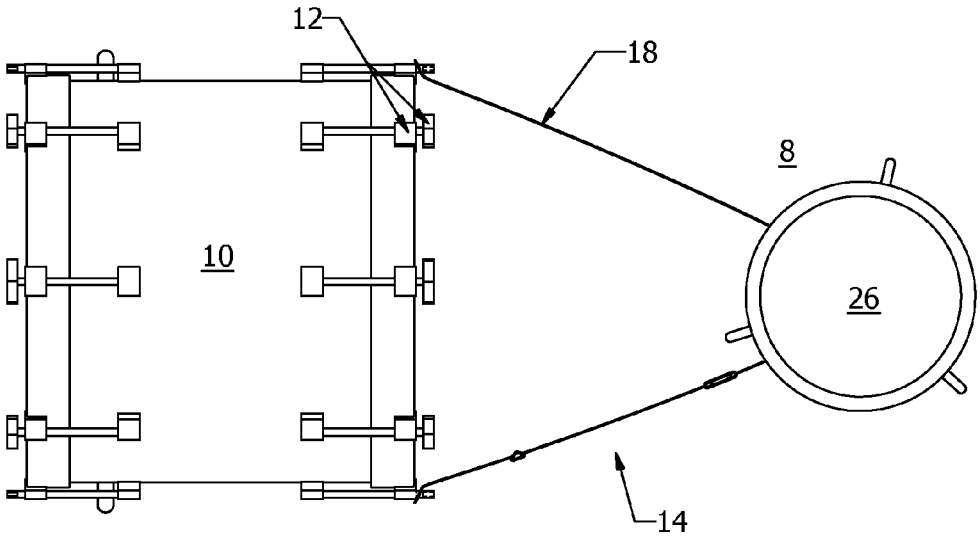
FIG. 6 illustrates a top view of the bass drum system.
Figure 7:
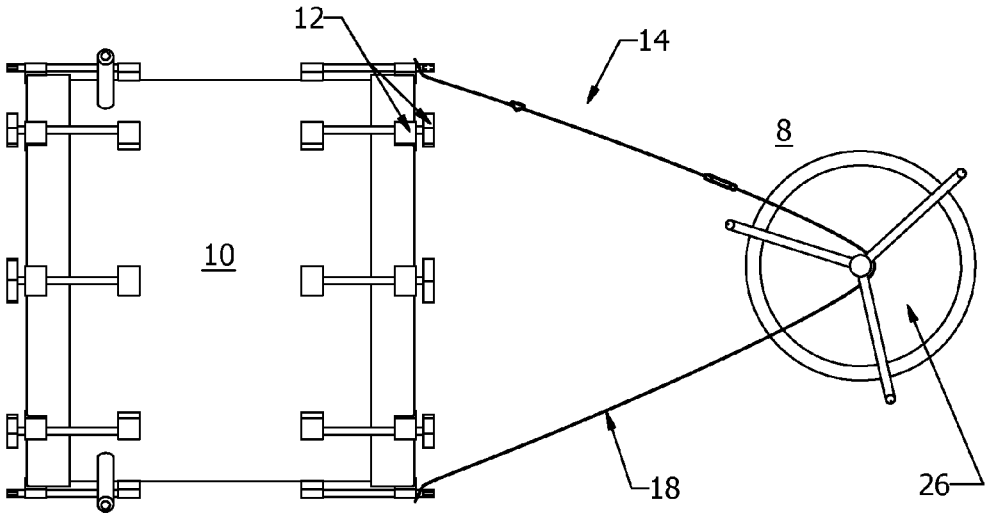
FIG. 7 illustrates a bottom view of the bass drum system.

FIGS. 6 and 7 illustrate top and bottom perspectives of the bass drum system 8, respectively. The anchoring harness 14 is attached to the bass drum 10 by the at least one first and second securing points, 16 and 20, respectively, to the at least one connector 12. The anchoring body 18 contacts the seat structure 26 and anchors the bass drum 10.

Figure 8:
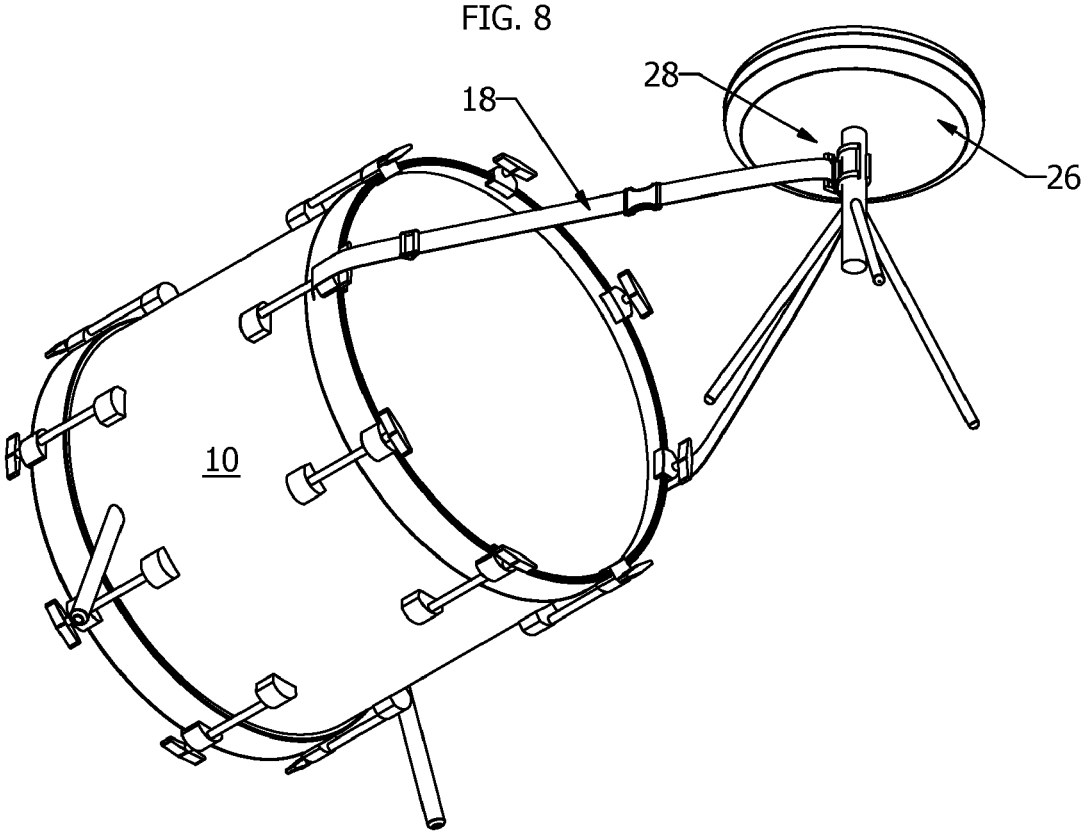
FIG. 8 illustrates a bottom view of the bass drum system including a seat contact.
Figure 9:
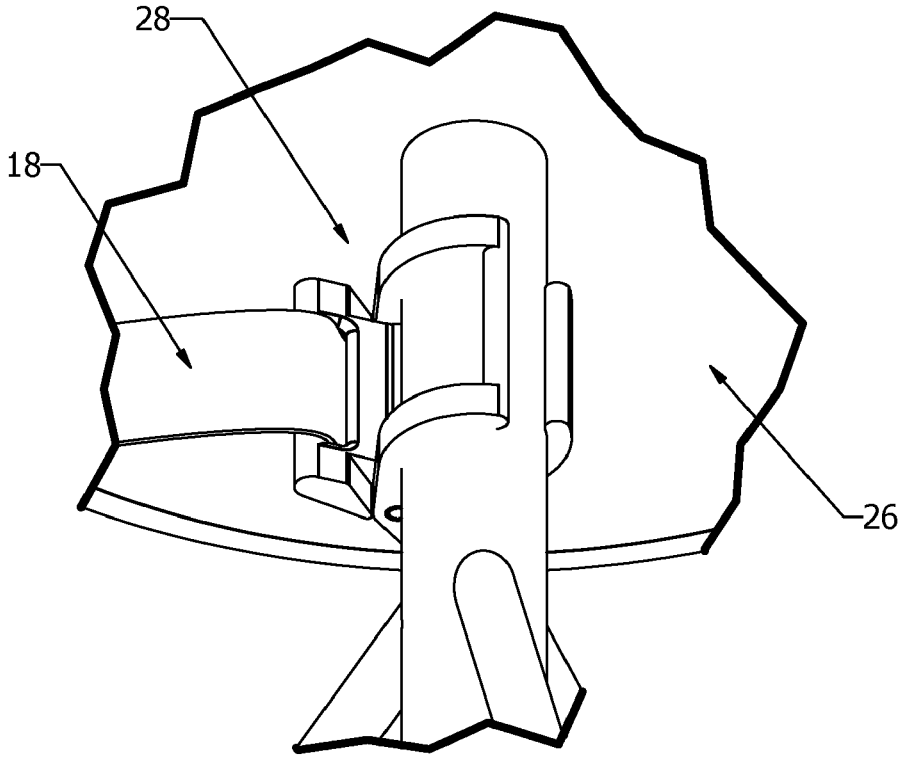
FIG. 9 illustrates the seat contact attached to a seat structure.

FIG. 8 illustrates another bottom perspective of the bass drum system 8. The anchoring harness 14 includes a seat contact 28. The anchoring harness 14 is attached to the seat structure 26 by the seat contact 28. FIG. 9 illustrates the seat contact 28 attached to the seat structure 26, in more detail.

In use, the bass drum system 8 prevents movement of the bass drum 10 while in play. The at least one first securing point 16 of the anchoring harness 14 is attached to the at least one connector 12 of the bass drum 10. In an embodiment, the at least one first securing point 16 is a built-in eyelet attaching to at least one connector 12, which is typically comprised of a tension rod and a lug. In this embodiment, the built-in eyelet attaches around the rod and is secured by the lug. In another embodiment, the at least one first securing point 16 is comprised of a clip, clamp, hook, connector, or other hardware or structure that is capable of attaching to or around the rod on the bass drum 10 and to the anchoring body 18.

The anchoring body 18 of the anchoring harness 14, contacts the seat structure 26. The seat structure 26 is used by a musician or "user" of the bass drum system 8 and provides the weight needed to prevent movement of the bass drum 10. In an embodiment, the anchoring body 18 is made of a synthetic polymer such as polyamide or nylon, polybutadiene, polyimide, polypropylene or other durable and resistant material. In another embodiment, the anchoring body 18 is comprised of hemp or other organic durable material.

In an embodiment, the anchoring body 18 includes the seat contact 28. The seat contact 28 is comprised of structure similar to that of the first securing point 16, and attaches to the posts of seats or other structure on the seat structure 26, which can be clasped or otherwise attached to. The seat contact 28, in another embodiment, includes a lock. In another embodiment, the seat contact 28 is adjustable, fitting the size of any attachment structure present on the seat structure 26.

The at least one second securing point 20 is comprised of structure similar to that of the at least one first securing point 16 and is attached to at least one connector 12 of the bass drum 10. In one embodiment, the at least one first and second securing points, 16 and 20, respectively, are attached to the same at least one connector 12. In another embodiment, the at least one first and second securing points, 16 and 20, are attached to the at least one connector 12 at respective end points on a diameter of the circumference of the bass drum 10.

The at least one first and second securing points, 16 and 20, are located at a predefined distance away from each other on the anchoring body 18. In an embodiment, the at least one first and second securing points, 16 and 20, are located at respective ends of the anchoring body 18. The degree of distance between the first and second securing points, 16 and 20, will depend on the application and type of structure used to connect the anchoring body 18 to the at least one connector 12.

In an embodiment, the at least one first securing point 16 attaches to the at least one connector 12 and the at least one second securing point 20, anchoring body 18, or seat contact 28, attaching to the anchoring body 18, attaches to the seat structure 26. This arrangement provides versatility to the prevention of bass drum movement by simplifying connection procedures and space in front of the user. Moreover, in another embodiment, a plurality of the at least one first securing points 16 are used, each attaching to a respective plurality of the at least one connectors 12 on the bass drum 10.

In an embodiment, the anchoring harness 14 includes the at least one modifying member 22. After attachment of the at least one first and second securing points, 16 and 20, the modifying member 22 is adjusted to a comfortable distance between the user and the bass drum 10, allowing the user to exert proper force on the bass drum 10. In another embodiment, the anchoring harness 14 includes the fastening member 24. The fastening member 24 includes a first and a second fastening end wherein the first and second fastening ends serve as male and female ends, respectively.

The fastening member 24 bifurcates the anchoring body 18 and allows the at least one first and second securing points, 16 and 20, to be attached before the anchoring body 18 contacts the seat structure 26. The embodiment allows for the anchoring harness 14 to be attached to the bass drum 10 without having to detach either the at least one first or second securing points, 16 and 20, to secure the bass drum 10 to the seat structure 26.

An advantage of the invention is that its use serves to eliminate the damage the prior art currently produces on the music stage. The prior art is unstable, heavy, cumbersome, and has complex procedures in which to assemble, and as such, an advantage of the invention is that it is lightweight and very easy to use. The invention is also highly effective and cost efficient. Another advantage of the invention is that the procedure in which the invention attaches does not interfere with the bass drum sound because the stress put on the bass drum by the prior art is eliminated.

While certain exemplary embodiments have been described and shown in the accompanying drawings, it is to be understood that such embodiments are merely illustrative and not restrictive of the current invention, and that this invention is not restricted to the specific constructions and arrangements shown and described since modification may occur to those ordinarily skilled in the art.

What is claimed:

1. A method for anchoring a bass drum, the method comprising:

attaching at least one first securing built-in eyelet in a first end of an anchoring harness to at least one tension rod of the bass drum, the anchoring harness further including an anchoring body having a length, a pinch-release clip disposed along the length of the anchoring body, a modifying member determining the length of the anchoring body, and at least one second securing built-in eyelet disposed distally along the length of the anchoring body at a predefined distance from the at least one second securing built-in eyelet;

contacting the anchoring body to a seat structure used by a user of the bass drum;

positioning the pinch release clip within easy reach of the drum user; and attaching the at least one second securing built-in eyelet to at least one tension rod of the bass drum.

2. The method of claim 1, wherein the at least one first and second securing built-in eyelets are attached to the same tension rod.

3. The method of claim 1, including adjusting the at least one modifying member, the modifying member connected to the anchoring body, determining a length of the anchoring body and a distance between the user and the bass drum.

4. The method of claim 1, wherein the anchoring body is comprised of a synthetic polymer.

5. The method of claim 1, wherein the anchoring harness includes a seat contact contacting the anchoring body and the seat structure.

6. A bass drum system, the system comprising:

a bass drum including at least one tension rod; and an anchoring harness including at least one first securing built-in eyelet in a first end of the anchoring harness, an anchoring body having a length, a pinch-release clip disposed along the length of the anchoring body, positioned within reach by a user of the bass drum, a modifying member determining the length of the anchoring body, and at least one second securing built-in eyelet disposed distally along the length of the anchoring body at a predefined distance from the at least one second securing built-in eyelet, wherein the at least one first securing built-in eyelet attaches to the at least one tension rod, the anchoring body contacting a seat structure used by the user of the bass drum, and the at least one second securing built-in eyelet attaching to the at least one tension rod.

7. The bass drum system of claim 6, wherein the at least one first and second securing built-in eyelets are attached to the same tension rod.

8. The bass drum system of claim 6, wherein the anchoring body is comprised of synthetic polymer fabric.

9. The bass drum system of claim 6, wherein the anchoring harness includes a seat contact contacting the anchoring body and the seat structure.

10. A method for anchoring a bass drum, the method comprising:

attaching at least one first securing built-in eyelet in a first end of an anchoring harness to at least one tension rod of the bass drum, the anchoring harness further including an anchoring body having a length, a pinch-release clip disposed along the length of the anchoring body, a modifying member determining the length of the anchoring body, and a seat attachment, the at least one first securing built-in eyelet disposed distally along the length of the anchoring body at a predefined distance from the seat attachment;

attaching the seat attachment to the seat structure used by a user of the bass drum; and positioning the pinch release clip within reach of the user of the bass drum.

11. The method of claim 10, wherein the anchoring body is comprised of synthetic polymer.

* * * * *